US009348302B2

(12) United States Patent
Kobayashi

(10) Patent No.: US 9,348,302 B2
(45) Date of Patent: May 24, 2016

(54) IMAGE FORMING APPARATUS, AND DETACHABLE BODY

(71) Applicant: FUJI XEROX CO., LTD., Tokyo (JP)

(72) Inventor: Takahiko Kobayashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 7 days.

(21) Appl. No.: 14/468,948

(22) Filed: Aug. 26, 2014

(65) Prior Publication Data

US 2015/0268624 A1 Sep. 24, 2015

(30) Foreign Application Priority Data

Mar. 20, 2014 (JP) ..... 2014-059095

(51) Int. Cl.
*G03G 15/00* (2006.01)
*G03G 21/16* (2006.01)

(52) U.S. Cl.
CPC ..... *G03G 21/1666* (2013.01); *G03G 21/1647* (2013.01); *G03G 2215/0132* (2013.01)

(58) Field of Classification Search
CPC ..... G03G 21/1676; G03G 21/1814; G03G 21/1647; G03G 21/1821; G03G 21/1666; G03G 21/1661; G03G 2221/1684; G03G 2221/1869; G03G 15/04045
USPC ..... 399/110, 118, 179, 206
See application file for complete search history.

(56) References Cited

U.S. PATENT DOCUMENTS 5,168,286 A * 12/1992 Okauchi ..... B41J 17/32 247/197
8,626,023 B2 * 1/2014 Suzuki ..... 399/110
2009/0190953 A1 * 7/2009 Okabe ..... 399/111
2010/0080623 A1 * 4/2010 Tanaka et al. ..... 399/118

FOREIGN PATENT DOCUMENTS

JP A-2008-286967 11/2008

* cited by examiner

*Primary Examiner* — Walter L Lindsay, Jr.
*Assistant Examiner* — Jessica L Eley
(74) *Attorney, Agent, or Firm* — Oliff PLC

(57) ABSTRACT

Provided is an image forming apparatus including an image forming apparatus main body, a detachable body that is detachably provided on the image forming apparatus main body, includes an image holding member, and moves along a predetermined moving path, and a light emitting member that performs a light emission to the image holding member, is pressed against the detachable body, and a portion of the light emitting member protrudes to the moving path, wherein a first portion of the light emitting member positioned on the moving path is pressed, the light emitting member is moved in a direction, a second portion positioned on the moving path is pressed, and the light emitting member is moved in a direction opposite to the second direction, and wherein one of the pressing of the first portion and the pressing of the second portion is performed first, and the other is performed later.

9 Claims, 10 Drawing Sheets

IMAGE FORMING APPARATUS, AND DETACHABLE BODY

CROSS-REFERENCE TO RELATED APPLICATIONS

This application is based on and claims priority under 35 USC 119 from Japanese Patent Application No. 2014-059095 filed Mar. 20, 2014.

BACKGROUND

Technical Field

The present invention relates to an image forming apparatus, and a detachable body.

SUMMARY

According to an aspect of the invention, there is provided an image forming apparatus including:

an image forming apparatus main body;

a detachable body that is detachably provided on the image forming apparatus main body, includes an image holding member which holds an image, and moves along a predetermined moving path in the image forming apparatus main body upon mounting on the image forming apparatus main body; and a light emitting member that performs a light emission to the image holding member, is pressed against the detachable body by being urged toward a first direction which is an emission direction of the light, is pressed against the detachable body by being urged toward a second direction intersecting with the first direction, and in a state where the detachable body is removed from the image forming apparatus main body, a portion of the light emitting member protrudes to the moving path, wherein, when the detachable body is mounted on the image forming apparatus main body, a first portion of the light emitting member positioned on the moving path is pressed by the detachable body, the light emitting member is moved in a direction opposite to the first direction, a second portion positioned on the moving path is pressed by the detachable body, and the light emitting member is moved in a direction opposite to the second direction, and wherein one of the pressing of the first portion by the detachable body and the pressing of the second portion by the detachable body is performed first, and the other is performed later.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described with reference to the accompanying drawings.

Figure 1:
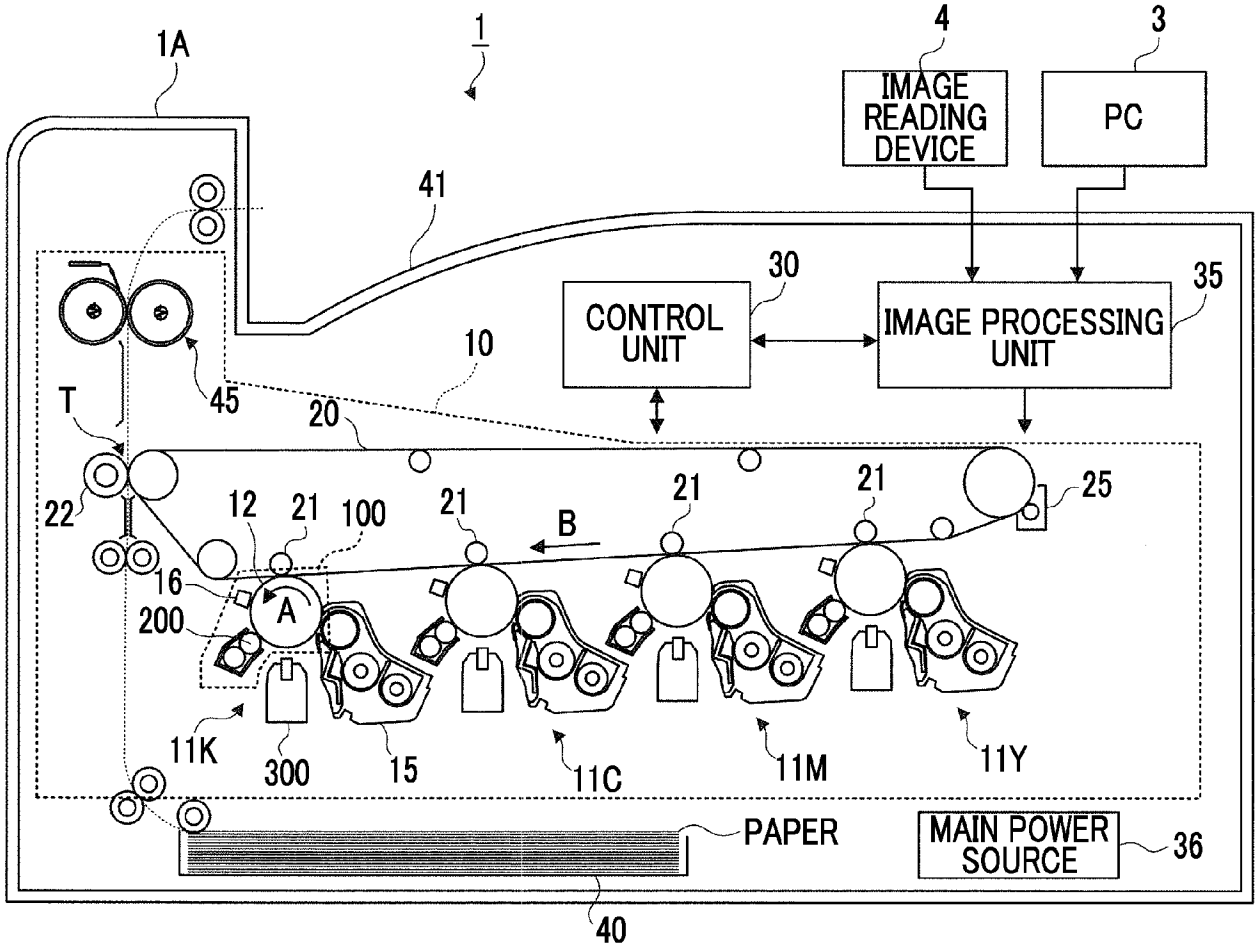
FIG. 1 is an overall configuration diagram of an image forming apparatus according to the exemplary embodiment viewed from the front side thereof.

FIG. 1 is an overall configuration diagram of an image forming apparatus 1 according to the exemplary embodiment viewed from the front side thereof. The image forming apparatus 1 in FIG. 1 is a so-called tandem type color printer, and includes an image forming process unit 10 that performs image forming according to image data of each color, a control unit 30 that controls the entire operation of the image forming apparatus 1, an image processing unit 35 that is connected to external devices such as, for example, a personal computer (PC) 3 or an image reading device 4 and executes image processing with respect to the image data received from the external device, and a main power source 36 that supplies power to each unit.

In the image forming process unit 10, four image forming units 11Y, 11M, 11C, and 11K (hereafter, also collectively referred to as simply "image forming unit 11") are disposed in parallel with a constant interval are included. Here, each image forming unit 11 is configured in substantially the same form except for a toner accommodated in a developing unit 15 (will be described below). Each image forming unit 11 forms a toner image of yellow (Y), magenta (M), cyan (C), and black (K), respectively.

In each image forming unit 11, a photoconductor unit 100 including a photoconductor drum 12 is provided. Furthermore, a charger 200 that charges the photoconductor drum 12 is provided in each image forming unit. In addition, an LED printer head (LPH) 300 that exposes the photoconductor drum 12 is provided.

The photoconductor unit 100 is provided so as to be detachable with respect to a main body 1A of the image forming apparatus 1, and may be removed from the main body 1A by pulling the photoconductor unit 100 in a front side direction of the sheet surface of FIG. 1. In other words, in the exemplary embodiment, the front side of the sheet surface of FIG. 1 is the front side of the image forming apparatus 1, and thus, the photoconductor unit 100 is removed from the main body 1A by pulling the photoconductor unit 100 to the front side of the image forming apparatus 1.

In addition, in the exemplary embodiment, by pushing the photoconductor unit 100 toward the rear side of the image forming apparatus 1, the photoconductor unit 100 may be mounted on the main body 1A of the image forming apparatus 1. A not illustrated guide unit is provided in the image forming apparatus 1, and the photoconductor unit 100 moves while being guided by the guide unit when the photoconductor unit 100 is detached.

In the photoconductor unit 100 as an example of a detachable body, the photoconductor drum 12 as an example of an image holding member that is rotatably disposed and holds a toner image and a frame (will be described below) that functions as a part of a detachable body main body are provided. The photoconductor drum 12 is supported by the frame.

The photoconductor drum 12 is charged by the charger 200. Furthermore, the photoconductor drum 12 is exposed by the LPH 300 and an electrostatic latent image is formed on the photoconductor drum 12. Furthermore, on the photoconductor unit 100, a cleaner (not illustrated) that cleans the surface of the photoconductor drum 12 is provided. In addition, the developing unit 15 that develops the electrostatic latent image formed on the photoconductor drum 12 is provided in the vicinity of the photoconductor unit 100.

The image forming process unit 10 will be described. In the image forming process unit 10, an intermediate image transfer belt 20 onto which the toner image of each color formed on the photoconductor drum 12 is transferred in multilayer, a primary image transfer roller 21 that sequentially transfers (primary transfer) the toner image of each color formed on the photoconductor drum 12 to the intermediate image transfer belt 20, a secondary image transfer roller 22 that collectively transfers (secondary transfer) the superimposed toner image transferred onto the intermediate image transfer belt 20 onto sheet which is a recording material, and a fixing unit 45 that fixes the secondarily transferred images on the sheet, are provided.

In the image forming apparatus 1 in the exemplary embodiment, the image data input from the PC 3 or the image reading device 4, on which the image processing is performed by the image processing unit 35, is supplied to each image forming unit 11 via an interface not illustrated. Then, for example, in the black (K) image forming unit 11K, the photoconductor drum 12, while rotating in the direction of arrow A, is charged by the charger 200 and is exposed by the LPH 300 that emits light based on the image data transmitted from the image processing unit 35.

In this way, on the photoconductor drum 12, the electrostatic latent image related to the black (K) image is formed. Then, the electrostatic latent image formed on the photoconductor drum 12 is developed by the developing unit 15, and then, the toner image of black (K) color is formed on the photoconductor drum 12. Similarly, in the image forming unit 11Y, the image forming unit 11M, and the image forming unit 11C, the toner image of each color of yellow (Y), magenta (M), and cyan (C) is formed respectively.

The toner image of each color formed on each image forming unit 11 is electrostatically absorbed sequentially on the intermediate image transfer belt 20 moving in a direction of arrow B by the primary image transfer roller 21, and then, a composed toner image in which the toner image of each color is superimposed is formed. The composed toner image on the intermediate image transfer belt 20 is transported to a region (secondary image transfer unit T) where the secondary image transfer roller 22 is disposed in accordance with the movement of the intermediate image transfer belt 20.

When the composed toner image is transported to the secondary image transfer unit T, the sheet is supplied to the secondary image transfer unit T from a sheet holding unit 40 in accordance with the timing at which the toner image is transported to the secondary image transfer unit T. Then, by a transfer field formed by the secondary image transfer roller 22 on the secondary image transfer unit T, the composed toner images are collectively and electrostatically transferred onto the transported sheet.

After that, the sheet on which the composed toner image is electrostatically transferred is separated from the intermediate image transfer belt 20 and transported to the fixing unit 45. The composed toner image on the sheet transported to the fixing unit 45 is fixed on the sheet on receiving the fixing process by the fixing unit 45 using heat or pressure. Then, the sheet on which the fixed image is formed is transported to an ejected sheet stacking member 41 provided on a discharge portion of the image forming apparatus 1.

On the other hand, the toner attached to the intermediate image transfer belt 20 after the secondary transfer (the toner remaining after transfer) is removed from the surface of the intermediate image transfer belt 20 by a belt cleaner 25 after finishing of the secondary transfer, and is provided for the next image forming cycle. In this way, the forming of the image in the image forming apparatus 1 is repeatedly performed over as many cycles as the number of pieces of printed sheet.

Figure 2:
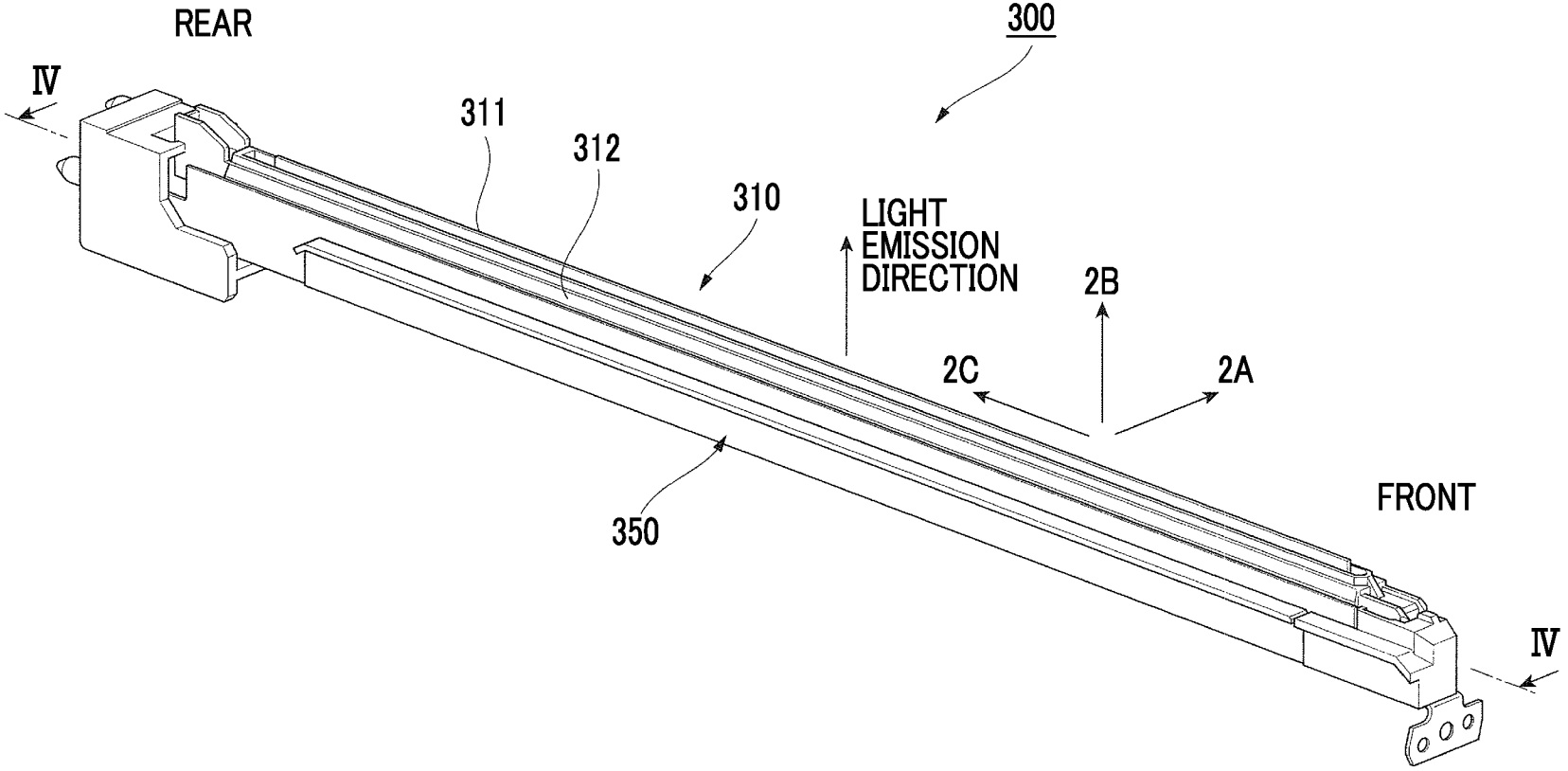
FIG. 2 is a perspective view of an LPH provided on each image forming unit.

FIG. 2 is a perspective view of the LPH 300 provided on each image forming unit 11. In FIG. 2, a portion of the right side of the LPH 300 in the figure is positioned at the front side of the image forming apparatus 1, and a portion of the left side in the figure is positioned at the rear side of the image forming apparatus 1.

The LPH 300 in the exemplary embodiment is disposed below the photoconductor drum 12 (refer to FIG. 1), and exposes the photoconductor drum 12 from the underneath side. In addition, in the LPH 300 in the exemplary embodiment, a light source unit 310 that includes an LED array (not illustrated) which is a light source and a housing 350 that supports the light source unit 310 are provided.

The light source unit 310 as an example of a light emitting member is accommodated in the housing 350. In addition, a first spring (described below) that urges the light source unit 310 to the direction indicated by an arrow 2A in the figure is provided between the side surface of the light source unit 310 and the inner surface of the housing 350. To describe additionally, the first spring that urges the light source unit 310 is provided toward the upstream side of the intermediate image transfer belt 20 (refer to FIG. 1) in the moving direction thereof (refer to the arrow B in FIG. 1).

Furthermore, a second spring (described below) that urges the light source unit 310 toward the direction indicated by an arrow 2B (upward direction in the figure) is provided between the bottom portion of the light source unit 310 and the bottom surface of the housing 350. To describe additionally, the second spring that urges the light source unit 310 in an optical axis direction (emitting direction) of the light emitted from the light source unit 310, is provided.

Hereinafter, in the specification, the direction indicated by the arrow 2A is referred to as a "belt movement reverse direction" and the direction indicated by the arrow 2B is referred to as an "optical axis direction". Furthermore, a direction indicated by an arrow 2C will be referred to as a "unit mounting direction".

Here, in the exemplary embodiment, when the photoconductor unit 100 is mounted with respect to the image forming apparatus 1, the photoconductor unit 100 moves in the direction indicated by the arrow 2C in the figure, and then, the photoconductor unit 100 is mounted on the image forming apparatus 1. To describe additionally, the photoconductor unit 100 moves along the linear-shaped moving path along the direction indicated by the arrow 2C, and the photoconductor unit 100 is mounted on the image forming apparatus 1.

In the light source unit 310, the LED array (not illustrated) which is the light source is provided. The LED array is configured to include a plural number of LEDs (light-emitting device) that are arranged side by side along the longitudinal direction (axial direction of the photoconductor drum 12 (refer to FIG. 1)) of the light source unit 310.

In addition, in the light source unit 310, a circuit board (not illustrated) for driving the LED array, a rod lens array 311 which is a lens member for forming an image from light from the LED array on the surface of the photoconductor drum 12, and a holder 312 that supports the rod lens array 311 and shields the LED array from the outside, are provided.

Figure 3:
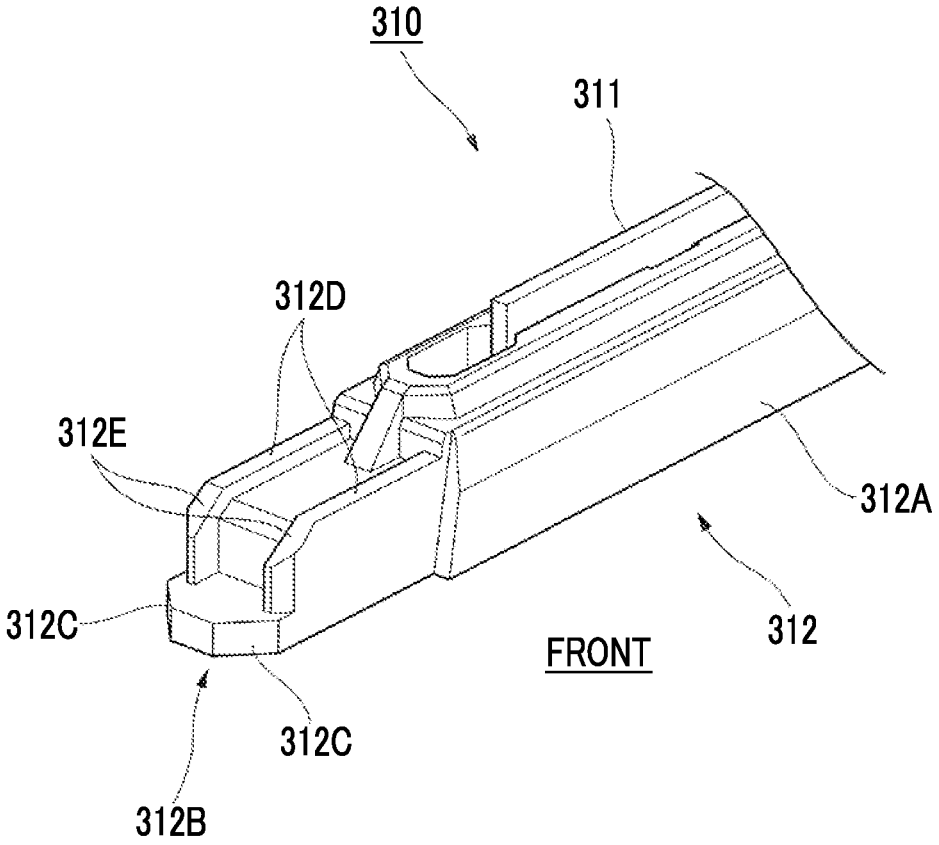
FIG. 3 is an enlarged diagram illustrating an end portion of a front side of a light source unit.

FIG. 3 is an enlarged diagram illustrating an end portion of the front side of the light source unit 310. In the holder 312 provided on the light source unit 310, a holder main body 312A disposed along the direction toward the rear of the image forming apparatus 1 (unit mounting direction) is provided. Furthermore, in the holder 312, a plate-shaped protruding piece 312B which protrudes from an end surface positioned at one end of the holder main body 312A in the longitudinal direction is provided.

The protruding piece 312B is formed so as to have a rectangular shape when viewed from the top, and further, two corner portions of the protruding piece 312B are chamfered. In the exemplary embodiment, by the chamfering, an inclined surface 312C as an example of a second portion is provided in each corner portion of the protruding piece 312B.

Furthermore, two protruding portions 312D which protrude from the upper surface of the holder main body 312A toward the upward direction in the figure are provided. Each protruding portion 312D is formed so as to be along the longitudinal direction of the holder main body 312A. Furthermore, each protruding portion 312D is shifted from the other in the width direction of the holder main body 312A (the direction orthogonal to the longitudinal direction of the holder main body 312A).

In addition, in the front side of the protruding portion 312D in the figure, a downward inclined surface 312E which is formed so as to continue to the upper surface of the protruding portion 312D and goes down by proceeding toward the front side in the figure, is provided. Two of the downward inclined surfaces 312E as an example of first portions are provided so as to correspond to each of the two provided protruding portions 312D.

In the exemplary embodiment, the downward inclined surface 312E is positioned at the rear side (downstream side) of the inclined surface 312C in the unit mounting direction (the direction indicated by the arrow 2C in FIG. 2). To describe additionally, in the exemplary embodiment, the installation positions of the downward inclined surface 312E and the inclined surface 312C are shifted in the unit mounting direction.

Figure 4:
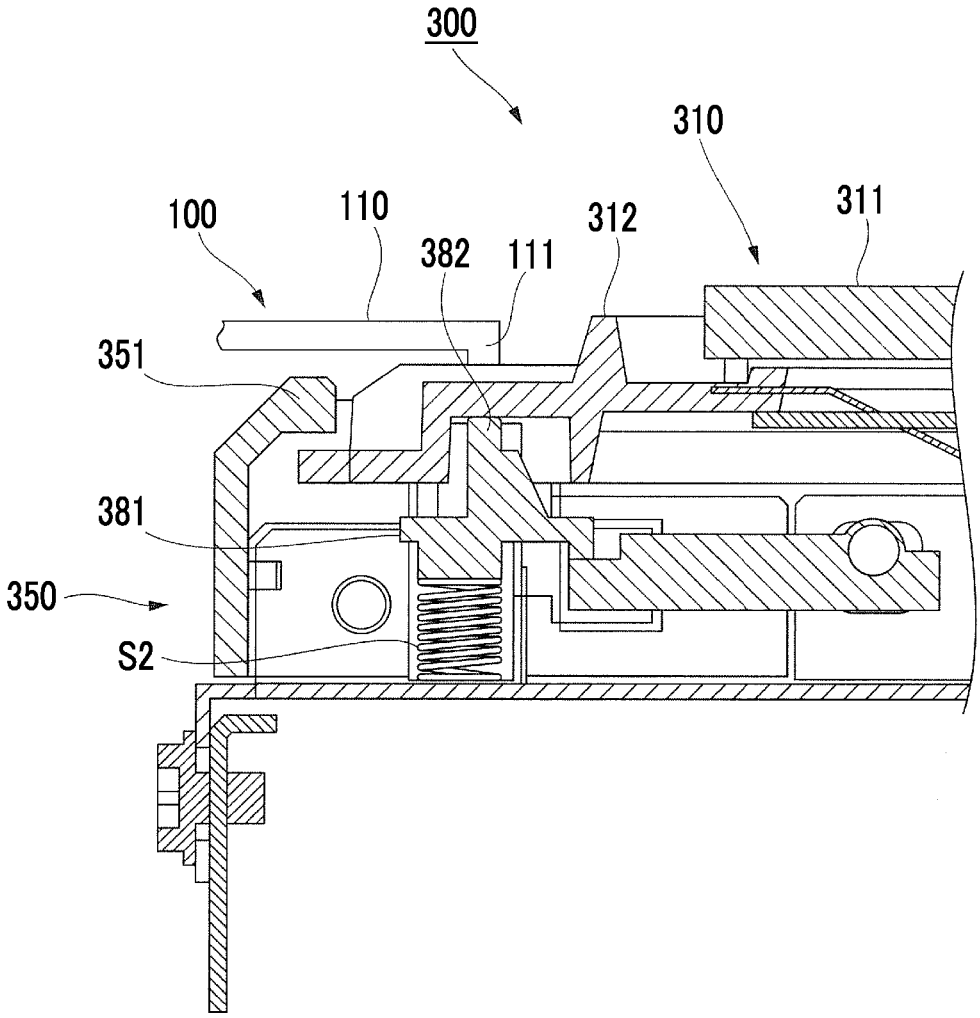
FIG. 4 is a cross-sectional view of the LPH taken along a line IV-IV in FIG. 2, and is a cross-sectional view of an end portion of a front side of the LPH.

FIG. 4 is a cross-sectional view of the LPH 300 taken along a line IV-IV in FIG. 2, and is a cross-sectional view of an end portion of the front side of the LPH 300.

As illustrated in FIG. 4, and as described above, in the exemplary embodiment, the second spring S2 that urges the light source unit 310 in the optical axis direction (light emission direction) is provided.

A reception member 381 that receives the load from the second spring S2 is provided between the second spring S2 and the light source unit 310, and in the exemplary embodiment, the light source unit 310 is urged via the reception member 381. In the reception member 381, a cross sectional area of a contact portion 382 which is in contact with the light source unit 310 is small. In this way, in the exemplary embodiment, the load from the second spring S2 acts on a predetermined narrow region in the light source unit 310.

Here, although not described above, in the exemplary embodiment, when the photoconductor unit 100 is mounted with respect to the image forming apparatus 1, as illustrated in FIG. 4, a frame 110 provided on the photoconductor unit 100 reaches the top of the light source unit 310. Then, the light source unit 310 is pushed down by a portion 111 (hereafter, referred to as a "first pressing portion 111") of the frame 110 determined in advance.

Specifically, the protruding portion 312D (refer to FIG. 3) of the light source unit 310 is pressed by the first pressing portion 111 and the light source unit 310 is pushed down.

Then, in this case, the light source unit 310 is in a state of being pressed from below with respect to the photoconductor unit 100 such that, in the optical axis direction, the position of the light source unit 310 with respect to the photoconductor unit 100 is determined.

In the exemplary embodiment, when mounting of the photoconductor unit 100 on the image forming apparatus 1 is finished, as illustrated in FIG. 4, the first pressing portion 111 is positioned at the facing position with respect to the contact portion 382 provided on the reception member 381. In a case where the first pressing portion 111 is positioned at the opposed position with respect to the contact portion 382, in comparison with a case where the first pressing portion 111 is not positioned at the facing position, a bending moment applied to the light source unit 310 decreases, and thus, warping of the light source unit 310 may be prevented.

Although not described above, as illustrated in FIG. 4, a locking portion 351 is provided at the housing 350 side, and thus, the light source unit 310 is prevented from being separated from the housing 350.

Figure 5:
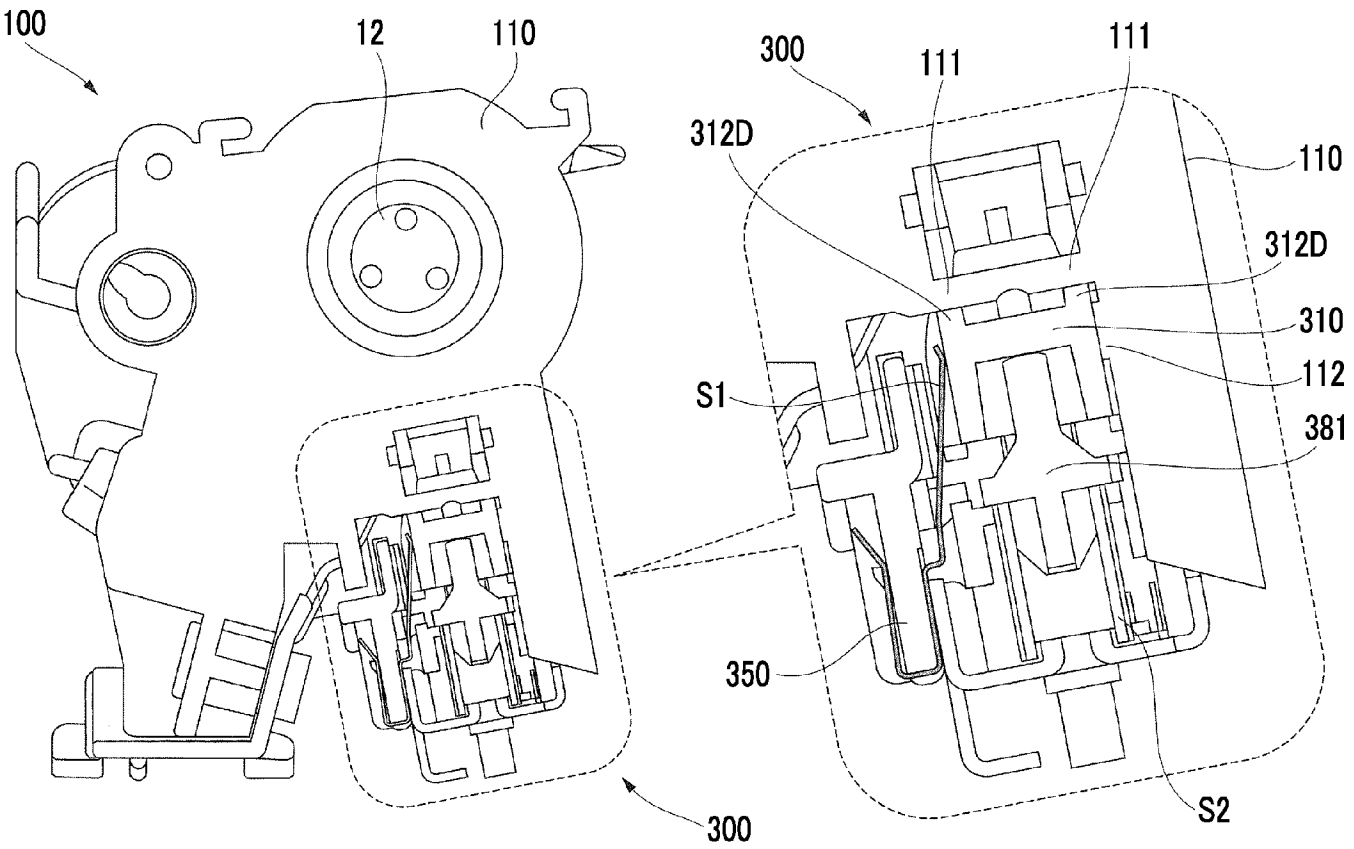
FIG. 5 is a diagram of a photoconductor unit and the LPH viewed from a front side of the image forming apparatus.

FIG. 5 is a diagram of the photoconductor unit 100 and the LPH 300 viewed from the front side of the image forming apparatus 1. To describe additionally, FIG. 5 is a diagram of the photoconductor unit 100 and the LPH 300 viewed in the state in which the photoconductor unit 100 is mounted on the image forming apparatus 1.

As described above, on the frame 110 of the photoconductor unit 100, the first pressing portion 111 that presses the protruding portion 312D of the light source unit 310 is provided. Two of the first pressing portions 111 are provided so as to correspond to each of two provided protruding portions 312D.

Furthermore, in the frame 110 of the photoconductor unit 100, a second pressing portion 112 that presses the side surface of the light source unit 310 is provided. Furthermore, at the side where the light source unit 310 is interposed and which is opposite to the side where the second pressing portion 112 is positioned, a first spring S1 that urges the light source unit 310 toward the second pressing portion 112 is provided. To describe additionally, as described above, the first spring S1 that urges the light source unit 310 toward the direction indicated by the arrow 2A in FIG. 2 is provided.

In the exemplary embodiment, the light source unit 310 is pressed to the second pressing portion 112 by the first spring S1, in the direction orthogonal to (crossing) the optical axis direction (direction in which the peripheral surface of the photoconductor drum 12 moves (direction in which a tangent line with respect to the photoconductor drum 12 extends)), the position of the light source unit 310 with respect to the photoconductor unit 100 is determined as well.

Generally, the accuracy of the position determination of the light source unit 310 in the optical axis direction is required to be higher than the accuracy of the position determination of the light source unit 310 in the direction orthogonal to the optical axis direction. As a result, in the exemplary embodiment, the spring force of the second spring S2 is larger than the spring force of the first spring S1, and the light source unit 310 is pressed against the first pressing portion 111 by a strong force.

To describe additionally, in the exemplary embodiment, a pressing load when the second spring S2 presses the light source unit 310 is larger than a pressing load when the first spring S1 presses the light source unit 310, and thus, the light source unit 310 is pressed to the first pressing portion 111 by the strong force, and the light source unit 310 is pressed against the second pressing portion 112 by a force weaker than above.

FIG. 6A to FIG. 9B are diagrams illustrating a motion of the light source unit 310 and the frame 110 when the photoconductor unit 100 is mounted on the image forming apparatus 1. FIGS. 6A, 7A, 8A, and 9A illustrate the states viewed from the top, and FIGS. 6B, 7B, 8B, and 9B illustrate the states viewed from the side.

Figure 6B:
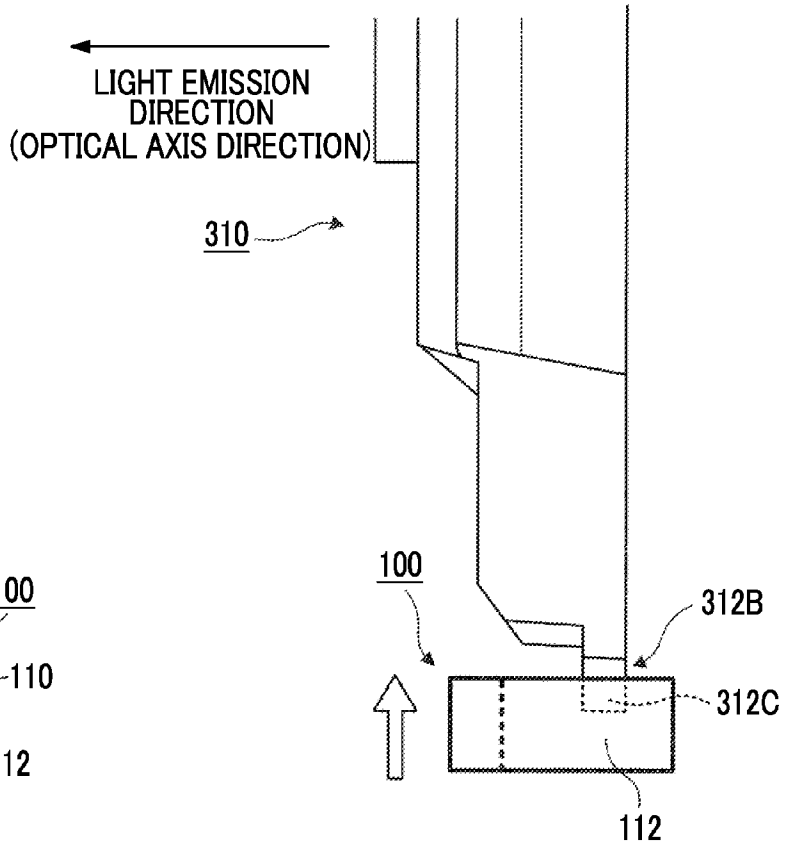
FIG. 6A and FIG. 6B are diagrams illustrating a motion of the light source unit and a frame when the photoconductor unit is mounted on the image forming apparatus.
Figure 6A:
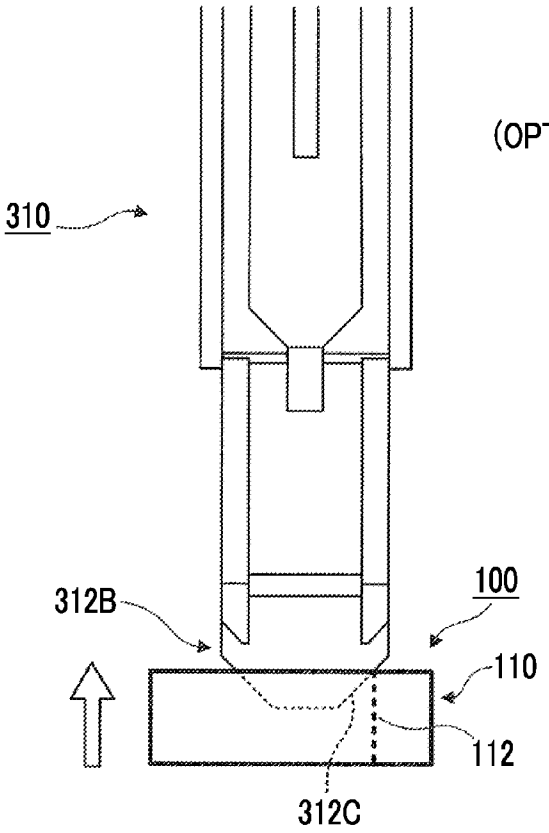

At the final stage of the mounting operation (inserting operation) of the photoconductor unit 100 on the image forming apparatus 1, firstly, as illustrated in FIG. 6A, the second pressing portion 112 provided on the photoconductor unit 100 collides with the inclined surface 312C of the protruding piece 312B provided on the light source unit 310.

To describe additionally, in the exemplary embodiment, in the protruding piece 312B, the portion where the inclined surface 312C is provided protrudes on the moving path of the photoconductor unit 100 (protrudes in the moving region of the photoconductor unit 100), and when the photoconductor unit 100 moves along the moving path, the second pressing portion 112 of the photoconductor unit 100 collides with the inclined surface 312C of the protruding piece 312B.

In this way, in FIG. 6A, the light source unit 310 moves to the left direction. To describe additionally, the light source unit 310 is retreated from the moving path of the photoconductor unit 100, and thus, the light source unit 310 moves toward the direction away from the moving path. To describe further, the light source unit 310 moves to the direction opposite to the direction in which the first spring S1 (refer to FIG. 5) urges the light source unit 310.

Figure 7B:
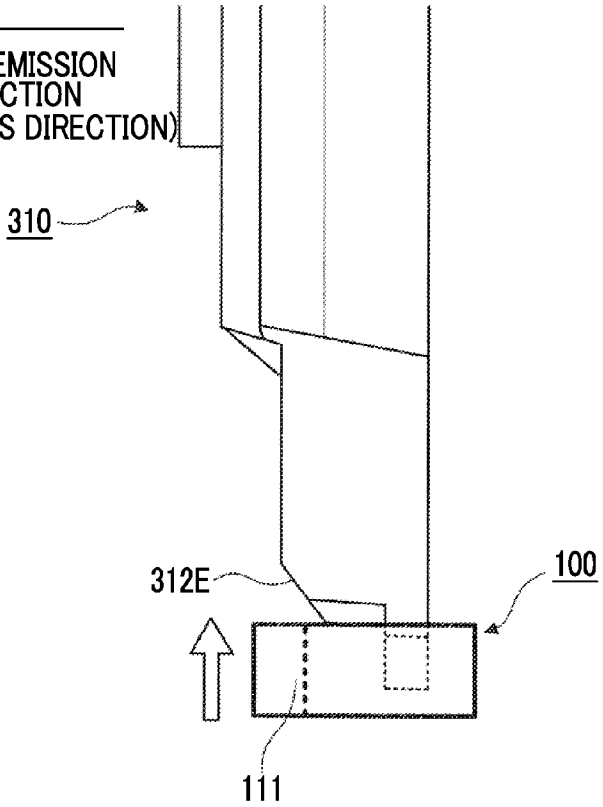
FIG. 7A and FIG. 7B are diagrams illustrating a motion of the light source unit and the frame when the photoconductor unit is mounted on the image forming apparatus.
Figure 7A:
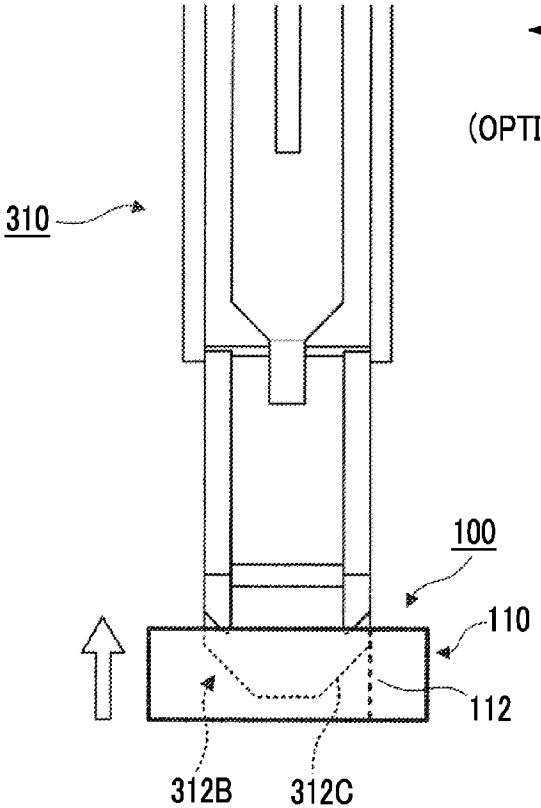

Then, when the photoconductor unit 100 is inserted into the image forming apparatus 1, as illustrated in FIG. 7A, the second pressing portion 112 is brought into contact with the side surface of the protruding piece 312B. At this time, as illustrated in FIG. 7B, the downward inclined surface 312E and the first pressing portion 111 are not in contact with each other yet.

Figure 8B:
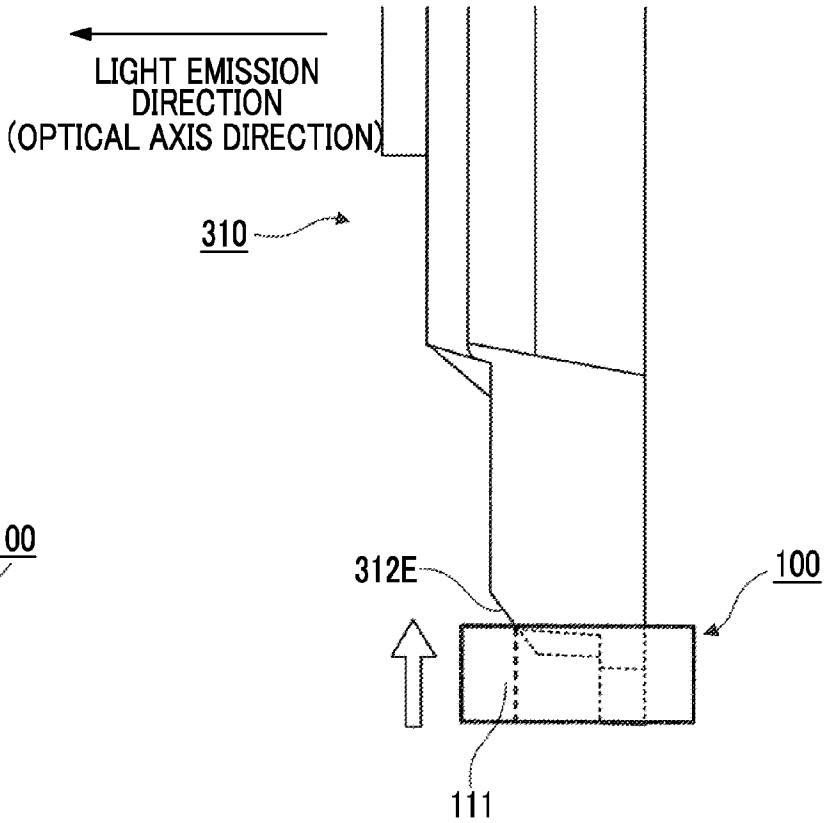
FIG. 8A and FIG. 8B are diagrams illustrating a motion of the light source unit and the frame when the photoconductor unit is mounted on the image forming apparatus.
Figure 8A:
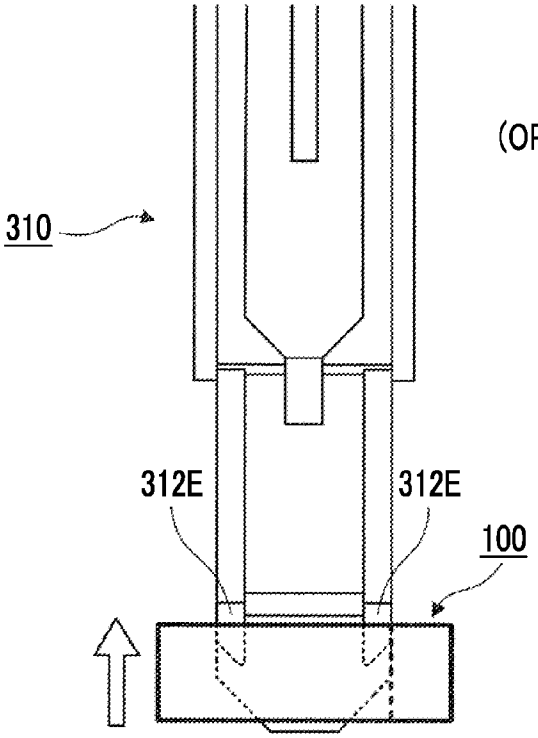

Then, when the photoconductor unit 100 is inserted into the image forming apparatus 1, as illustrated in FIG. 8B, the first pressing portion 111 starts to come into contact with the downward inclined surface 312E. To describe additionally, in the exemplary embodiment, the portion where the downward inclined surface 312E is provided also protrudes on the moving path of the photoconductor unit 100, and thus, when the photoconductor unit 100 moves along the moving path, the first pressing portion 111 of the photoconductor unit 100 collides with the downward inclined surface 312E.

In this way, in FIG. 8B, the light source unit 310 moves to the right direction. To describe additionally, the light source unit 310 moves toward the direction opposite to the light emission direction at the time of light emission by the light source unit 310. To describe further, the light source unit 310 is retreated from the moving path of the photoconductor unit 100.

Figure 9B:
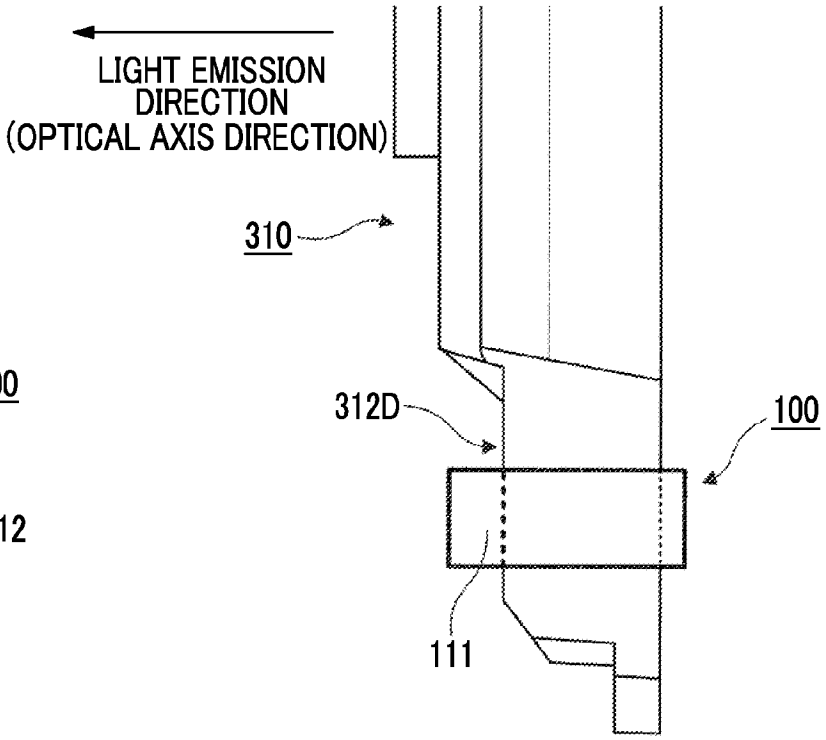
FIG. 9A and FIG. 9B are diagrams illustrating a motion of the light source unit and the frame when the photoconductor unit is mounted on the image forming apparatus.

When the photoconductor unit 100 is inserted into the image forming apparatus 1 and the mounting of the photoconductor unit 100 is finished, as illustrated in FIG. 9B, the first pressing portion 111 is in contact with the upper surface of the protruding portion 312D.

Figure 9A:
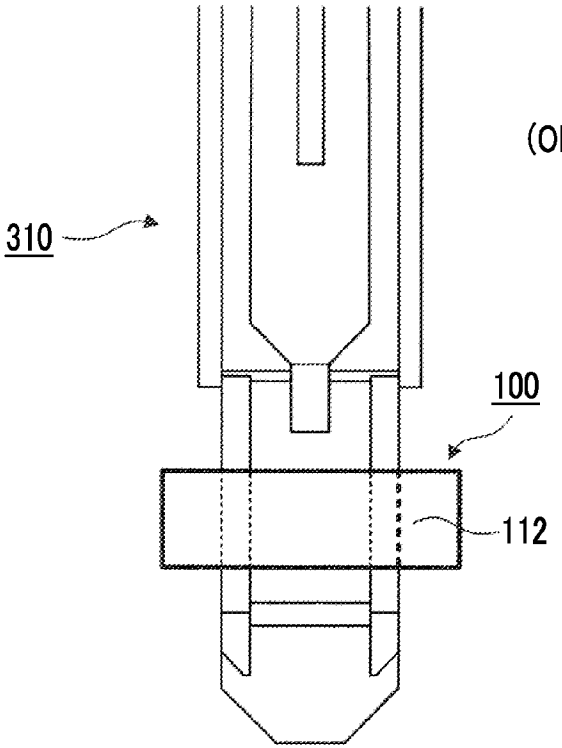

Here, in a state illustrated in FIG. 9A and FIG. 9B, the light source unit 310 is pressed against the first pressing portion 111, in the optical axis direction (light emission direction), the position of the light source unit 310 is determined. In addition, as illustrated in FIG. 9A, the light source unit 310 is pressed against the second pressing portion 112, and thus, the position of the light source unit 310 in the direction orthogonal to the optical axis direction is also determined.

Figure 10:
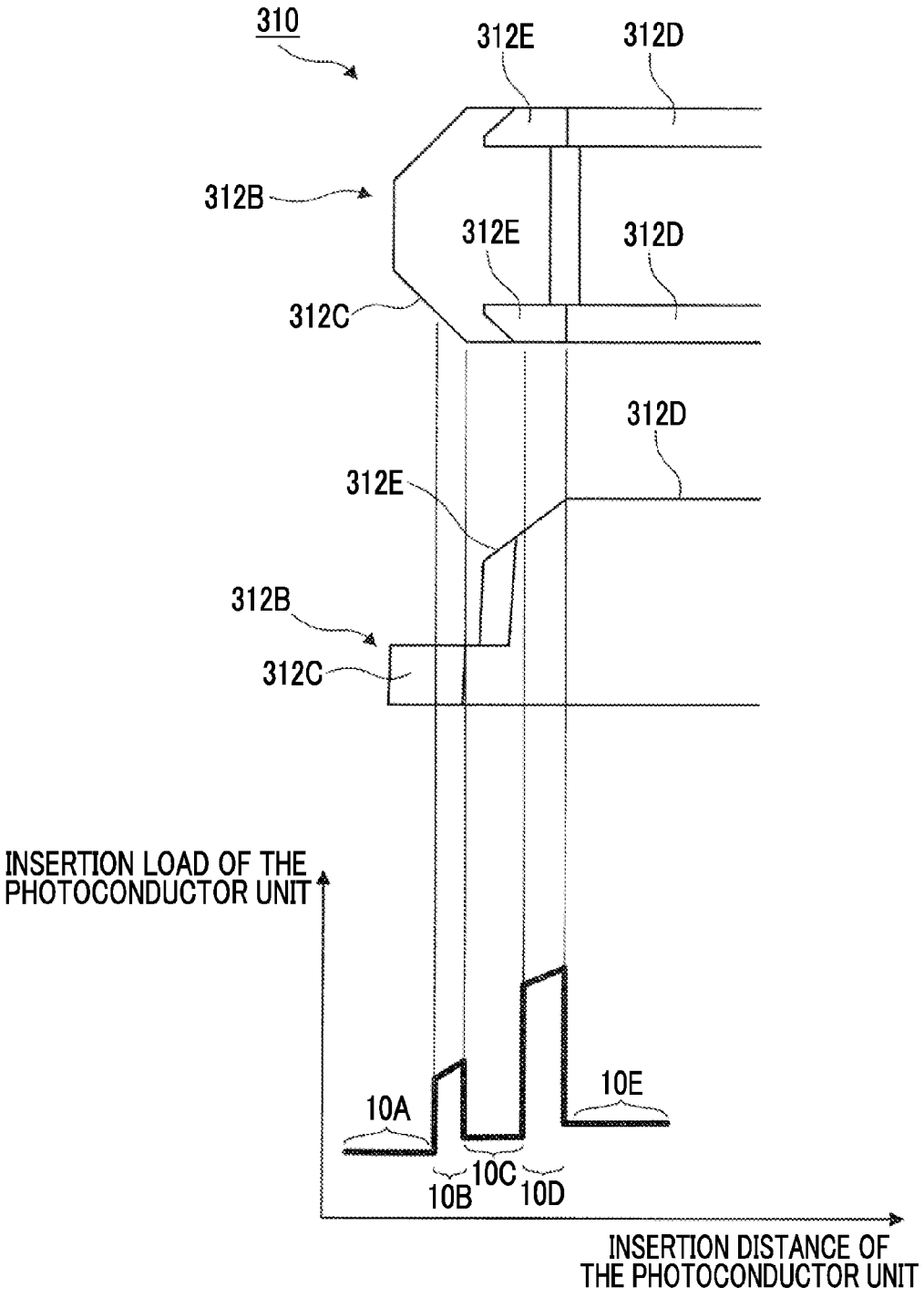
FIG. 10 is a diagram illustrating an operation load when the photoconductor unit is mounted on (inserted in) the image forming apparatus by a user (a wearer).

FIG. 10 is a diagram illustrating an operation load when the photoconductor unit 100 is mounted on (inserted in) the image forming apparatus 1 by a user (a wearer). To describe additionally, FIG. 10 is a diagram illustrating the operation load at the final stage of the mounting operation (inserting operation) of the photoconductor unit 100 on the image forming apparatus 1.

A stage illustrated by a reference numeral 10A in FIG. 10 is a stage before the photoconductor unit 100 is in contact with the light source unit 310, and at the stage indicated by the reference numeral 10A, a resistive force caused by friction between a portion other than the light source unit 310 of the image forming apparatus 1 and the photoconductor unit 100 acts on the photoconductor unit 100.

A stage illustrated by a reference numeral 10B is a stage in which the second pressing portion 112 of the photoconductor unit 100 is in contact with the inclined surface 312C of the protruding piece 312B. At the stage illustrated by the reference numeral 10B, since the photoconductor unit 100 is inserted while the light source unit 310 is caused to move against the urging force from the first spring S1 (refer to FIG. 5), the operation load is increased. To describe additionally, at the stage indicated by the reference numeral 10B, the light source unit 310 receives not only the resistive force caused by the friction but also the resistive force caused by the first spring S1. Therefore, the operation load is large in comparison with the stage indicated by the reference numeral 10A.

A stage illustrated by a reference numeral 10C is a stage in which the photoconductor unit 100 moves while the photoconductor unit 100 is rubbing the side surface of the light source unit 310. At the stage illustrated by the reference numeral 10C, the photoconductor unit 100 is required to be inserted in a state where the light source unit 310 urged by the first spring S1 is pressed by the photoconductor unit 100. Therefore, the required operation load is large in comparison with the stage indicated by the reference numeral 10A.

A stage illustrated by a reference numeral 10D is a stage in which the first pressing portion 111 of the photoconductor unit 100 is in contact with the downward inclined surface 312E. At the stage indicated by the reference numeral 10D, since the photoconductor unit 100 is inserted while the light source unit 310 is caused to move against the urging force from the second spring S2 (refer to FIG. 4), the operation load is increased. To describe additionally, at the stage indicated by the reference numeral 10D, the second spring S2 needs to be shrunk. Therefore, the operation load is large in comparison with the stage indicated by the reference numeral 10C.

In the exemplary embodiment, as described above, the pressing load when the second spring S2 presses the light source unit 310 is larger than the pressing load when the first spring S1 presses the light source unit 310. Therefore, in the exemplary embodiment, the operation load required at the stage indicated by the reference numeral 10D is large in comparison with that required at the stage indicated by the reference numeral 10B.

A stage illustrated by a reference numeral 10E is a stage in which the photoconductor unit 100 moves while the photoconductor unit 100 is rubbing a portion positioned at the rear side with respect to the downward inclined surface 312E of the light source unit 310. At this stage, friction occurs between the upper surface of the light source unit 310 (the upper surface of the protruding portion 312D) and the photoconductor unit 100.

To describe additionally, at the stage indicated by the reference numeral 10C, friction occurs between the side surface of the light source unit 310 and the photoconductor unit 100, however, at the stage indicated by the reference numeral 10E, friction occurs between the upper surface of the light source unit 310 and the photoconductor unit 100.

For this reason, at the stage indicated by the reference numeral 10E, a larger operation load is required than at the stage indicated by the reference numeral 10C.

Here, although not described above, in the exemplary embodiment, the photoconductor unit 100 is not in contact with the inclined surface 312C and the downward inclined surface 312E simultaneously. In this way, operation load (maximum value of the operation load) required for the mounting of the photoconductor unit 100 is small in comparison with the case of being in contact simultaneously.

To describe additionally, a timing when the photoconductor unit 100 is in contact with the inclined surface 312C and a timing when the photoconductor unit 100 is in contact with downward inclined surface 312E are different from each other, and thus, the operation load required for the mounting of the photoconductor unit 100 is small in comparison with that in the case where the timings are the same. Then, in this case, it is easy for a user to mount the photoconductor unit 100 in comparison with the case of simultaneous contact and thereby the operation load being large.

In the exemplary embodiment, an aspect in which the photoconductor unit 100 is firstly in contact with the inclined surface 312C and is in contact with the downward inclined surface 312E thereafter, is described as an example. However, the positions of the inclined surface 312C and the downward inclined surface 312E may be exchanged, and the photoconductor unit 100 may be firstly in contact with the downward inclined surface 312E and in contact with the inclined surface 312C thereafter. In this case, the operation load (maximum load) required for the mounting of the photoconductor unit 100 is also small in comparison with that in the case where the photoconductor unit 100 is in contact with the inclined surface 312C and the downward inclined surface 312E simultaneously.

In the exemplary embodiment, by causing the photoconductor unit 100 to firstly be in contact with the inclined surface 312C and to be in contact with the downward inclined surface 312E thereafter, the improvement of the accuracy in the position determining of the light source unit 310 or the improvement of an operability of the photoconductor unit 100 may be achieved.

Here, an aspect in which the light source unit 310 is firstly in contact with the downward inclined surface 312E and is in contact with the inclined surface 312C positioned on the rear side of the downward inclined surface 312E thereafter, may be considered.

In such an aspect, firstly, the light source unit 310 is pressed by the photoconductor unit 100, and subsequently, the light source unit 310 moves in the direction orthogonal to the optical axis direction.

Incidentally, in the aspect, when the photoconductor unit 100 is caused to be in contact with the inclined surface 312C and the light source unit 310 is caused to move in the direction orthogonal to the optical axis direction, a large friction force caused by the second spring S2 acts between the light source unit 310 and the photoconductor unit 100, and then, it becomes difficult for the light source unit 310 to move in the direction orthogonal to the optical axis direction. Then, in this case, there is a concern that the light source unit 310 may be disposed at a position different from the original position.

On the other hand, in a case where the photoconductor unit 100 is firstly in contact with the inclined surface 312C, in a state in which the above described frictional force caused by the second spring S2 does not act, the light source unit 310 moves in the direction orthogonal to the optical axis direction. In such a case, the disposition accuracy when the light source unit 310 is disposed at a predetermined position is improved.

In addition, in a case where the photoconductor unit 100 is caused to be in contact with the inclined surface 312C firstly and thereafter the photoconductor unit 100 is caused to be in contact with the downward inclined surface 312E, such a problem that the user stops the mounting operation of the photoconductor unit 100 on the way is less likely to occur.

Here, in a case where the photoconductor unit 100 is caused to be in contact with the downward inclined surface 312E firstly, since the light source unit 310 is pushed down against the second spring S2 of which the spring force is large, the initial operation load is required to be large.

Subsequently, when the photoconductor unit 100 is in contact with the inclined surface 312C, the operation load increases again. However, in this case, since the light source unit 310 is caused to move against the first spring S1, in comparison with the case where the light source unit 310 is pushed down as described above, the required operation load is small. That is, in the aspect, the initial operation load is large and the subsequent operation load is small.

Incidentally, according to the knowledge of the inventor, in a case where an object to be mounted such as the photoconductor unit 100 is inserted to be mounted on the image forming apparatus 1, when the operation load temporarily and rapidly increases, the user considers that there may be a possibility of a failure of the apparatus (damage of the members), and stops the operation on the way. Here, as described above, in a case where the initial operation load is large, similarly, the user considers that there may be a possibility of a failure of the apparatus (damage of the members) and stops the operation on the way.

On the other hand, in a case where the photoconductor unit 100 is caused to be in contact with the inclined surface 312C firstly and thereafter the photoconductor unit 100 is caused to be in contact with the downward inclined surface 312E, as illustrated in FIG. 10, a small operation load is applied to the photoconductor unit 100 before the large operation load is applied. In such a case, it is difficult for the user to feel the large operation load to be large, and the possibility that amounting operation may be performed to the end increases.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming apparatus main body;

a detachable body that is detachably provided on the image forming apparatus main body, includes an image holding member which holds an image, and moves along a predetermined moving path in the image forming apparatus main body upon mounting on the image forming apparatus main body; and a light emitting member that performs a light emission to the image holding member, is pressed against the detachable body by being urged toward a first direction which is an emission direction of the light, is pressed against the detachable body by being urged toward a second direction intersecting with the first direction, and in a state where the detachable body is removed from the image forming apparatus main body, a portion of the light emitting member protrudes to the moving path, wherein, when the detachable body is mounted on the image forming apparatus main body, a first portion of the light emitting member positioned on the moving path is pressed by the detachable body, the light emitting member is moved in a direction opposite to the first direction, a second portion positioned on the moving path is pressed by the detachable body, and the light emitting member is moved in a direction opposite to the second direction, wherein one of the pressing of the first portion by the detachable body and the pressing of the second portion by the detachable body is performed first, and the other is performed later, and when an urging force that urges the light emitting member toward the first direction is larger than an urging force that urges the light emitting member toward the second direction.

2. The image forming apparatus according to claim 1, wherein an installation position of the first portion in a moving direction when the detachable body moves along the moving path and an installation position of the second portion in the moving direction are shifted from each other, and one of the pressing of the first portion by the detachable body and the pressing of the second portion by the detachable body is performed first, and the other is performed later.

3. The image forming apparatus according to claim 2, wherein an urging force that urges the light emitting member toward the first direction is larger than an urging force that urges the light emitting member toward the second direction, and wherein the pressing of the second portion by the detachable body is performed first, and the pressing of the first portion by the detachable body is performed subsequently.

4. The image forming apparatus according to claim 3, wherein a user who mounts the detachable body on the image forming apparatus main body needs to apply a first operation load to the detachable body when the pressing performed first is performed, and needs to apply a second operation load to the detachable body when the pressing performed later is performed, among the pressing of the first portion by the detachable body and the pressing of the second portion by the detachable body, and wherein the first operation load is smaller than the second operation load.

5. The image forming apparatus according to claim 2, wherein a user who mounts the detachable body on the image forming apparatus main body needs to apply a first operation load to the detachable body when the pressing performed first is performed, and needs to apply a second operation load to the detachable body when the pressing performed later is performed, among the pressing of the first portion by the detachable body and the pressing of the second portion by the detachable body, and wherein the first operation load is smaller than the second operation load.

6. The image forming apparatus according to claim 1, wherein the pressing of the second portion by the detachable body is performed first, and the pressing of the first portion by the detachable body is performed subsequently.

7. The image forming apparatus according to claim 6, wherein a user who mounts the detachable body on the image forming apparatus main body needs to apply a first operation load to the detachable body when the pressing performed first is performed, and needs to apply a second operation load to the detachable body when the pressing performed later is performed, among the pressing of the first portion by the detachable body and the pressing of the second portion by the detachable body, and wherein the first operation load is smaller than the second operation load.

8. The image forming apparatus according to claim 1, wherein a user who mounts the detachable body on the image forming apparatus main body needs to apply a first operation load to the detachable body when the pressing performed first is performed, and needs to apply a second operation load to the detachable body when the pressing performed later is performed, among the pressing of the first portion by the detachable body and the pressing of the second portion by the detachable body, and wherein the first operation load is smaller than the second operation load.

9. A detachable body comprising:

a detachable body main body that is detachably provided on an image forming apparatus including a light emitting member which is urged in a light emission direction and a direction intersecting with the light emission direction, includes an image holding member that receives light emitted from the light emitting member, and moves along a predetermined moving path in the image forming apparatus main body upon mounting on the image forming apparatus main body;

a first pressing portion, when detachable body main body moves on the moving path and is mounted on the image forming apparatus, that presses a protrusion portion of the light emitting member protruding on the moving path to move the light emitting member in a direction opposite to the light emission direction; and a second pressing portion, when detachable body main body moves on the moving path and is mounted on the image forming apparatus, at a timing different from a timing when the first pressing portion presses the protrusion portion, that presses a portion of the light emitting member positioned on the moving path to move the light emitting member to a direction opposite to the one direction, wherein an urging force that urges the light emitting member toward the first direction is larger than an urging force that urges the light emitting member toward the second direction.

* * * * *